US005289184A

United States Patent [19]

Suzuki

[11] Patent Number: 5,289,184

[45] Date of Patent: Feb. 22, 1994

[54] ROAD MAP DISPLAYING SYSTEM FOR AUTOMOTIVE VEHICLE

[75] Inventor: Hidetaka Suzuki, Yokohama, Japan

[73] Assignee: Nissan Motor Co., Ltd., Japan

[21] Appl. No.: 836,905

[22] Filed: Feb. 19, 1992

[30] Foreign Application Priority Data

Mar. 28, 1991 [JP] Japan ..... 3-090046

[51] Int. Cl.[5] ..... G08G 1/09

[52] U.S. Cl. ..... 340/905; 340/988; 340/995

[58] Field of Search ..... 340/905, 907, 995, 990, 340/988, 936, 937; 364/436, 437, 438, 444, 449; 455/186, 228, 34.1, 53.1

[56] References Cited

U.S. PATENT DOCUMENTS

| | | | |
|---|---|---|---|
| 4,301,506 | 11/1981 | Turco | 340/988 |
| 4,409,583 | 10/1983 | Dahan et al. | 340/995 |
| 5,095,532 | 3/1992 | Mardus | 340/905 |
| 5,131,020 | 7/1992 | Liebesny et al. | 340/905 |
| 5,132,684 | 7/1992 | Pecker et al. | 340/990 |
| 5,146,219 | 9/1992 | Zechnall | 340/905 |
| 5,173,691 | 12/1992 | Sumner | 340/905 |

FOREIGN PATENT DOCUMENTS

| | | | |
|---|---|---|---|
| 0289657 | 11/1988 | European Pat. Off. | 340/905 |
| 58-143370 | 8/1983 | Japan . | |
| 9005969 | 5/1990 | World Int. Prop. O. | 340/905 |

*Primary Examiner*—Brent Swarthout

*Attorney, Agent, or Firm*—Lowe, Price, LeBlanc & Becker

[57] ABSTRACT

A road map displaying system for an automotive vehicle for displaying road information transmitted by a radio beacon transmitter (1) on a display unit (6) of an automotive vehicle comprises: a radio receiver (3) for receiving road information including position data and traffic snarl data transmitted by the radio beacon transmitter; a memory unit (4) for storing various road maps; and a processing unit (5) for selecting a current road map on the basis of the received position data, displaying traffic snarl information on the selected road map on the basis of the received traffic snarl data, measuring time elapsed after the road information has been received, and in particular, deleting the traffic snarl information displayed on the selected road map, when a predetermined timer or distance-related condition is satisfied after the road information has been received. Since the old traffic snarl information can be deleted, a more reliable traffic information can be provided to the driver, without confusing the driver with the old road information.

19 Claims, 6 Drawing Sheets

ROAD MAP DISPLAYING SYSTEM FOR AUTOMOTIVE VEHICLE

BACKGROUND OF THE INVENTION

1. Field of the Invention

The present invention relates to a road map displaying system for an automotive vehicle, which can display various road information received through communication on a road map related to the route along which the vehicle is now travelling, and more specifically to an improvement in reliability of road information displayed on the road map.

2. Description of the Prior Art

There has been known a road map displaying system for an automotive vehicle for guiding the vehicle to a destination without delay, by displaying various road information such as traffic snarl on a road map along a route of which the vehicle is guided to a destination, as disclosed in Japanese Published Unexamined (Kokai) Patent Application No. 58-143370, for instance.

In the displaying systems of this sort, traffic snarl sections are usually displayed on the road map in color according to the traffic snarl conditions on the basis of road information transmitted from traffic radio beacon transmitters arranged along roads. Further, the displayed information such as traffic snarl sections can be updated whenever new road information is received from another radio beacon transmitted arranged at another position. The road information transmitted from the radio beacon transmitter includes position data and traffic snarl data, for instance. The position data indicates the position at which the radio beacon transmitter is arranged, and therefore provides information of the current position where the vehicle is now travelling. The traffic snarl data indicates the road sections where traffic is snarled due to rush hours, seasonal trips or journeys, accidents, construction, no passing, etc. Since traffic snarl varies momentarily, the most updated traffic snarl data must be provided for drivers. Further, since the above-mentioned traffic radio beacon transmitters are not necessarily arranged along all roads, there exists of course the case where the vehicle travels on the road along which no radio beacon transmitters are arranged.

In the prior-art road map displaying system for an automatic vehicle, however, there exists a problem in that preceding road information (e.g. traffic snarl) transmitted by a radio beacon transmitter is kept displayed on the road map, and therefore the driver is confused with the preceding traffic snarl information. The above-mentioned undesirable condition occurs when the vehicle first travels on a road along which radio beacon transmitters are arranged and then travels on another road along which no radio beacon transmitters are arranged. This is because the preceding road information is not updated by the succeeding radio beacon transmitter.

SUMMARY OF THE INVENTION

With these problems in mind, therefore, it is the primary object of the present invention to provide a road map displaying system for an automotive vehicle, which can improve the reliability of traffic snarl information displayed on a road map related to the position where the vehicle is now travelling.

To achieve the above-mentioned object, the first aspect of the present invention provides a road map displaying system for an automative vehicle for displaying road information transmitted by fixed transmitters on a display unit of an automotive vehicle, which comprises: (a) means for receiving road information including position data and traffic snarl data transmitted by the fixed transmitters; (b) means for storing a plurality of road maps; (c) means for selecting a current road map from those stored in said storing means on the basis of the received position data; (d) means for displaying traffic snarl information on the selected road map on the basis of the received traffic snarl data; (e) means for measuring time elapsed after the road information from the fixed transmitter has been received by said receiving means; and (f) means for deleting the traffic snarl information displayed on the selected road map, when a predetermined time-related condition is satisfied after the road information has been received.

Further, the first aspect of the present invention provides a method of displaying road information transmitted by fixed transmitters on a display unit for an automotive vehicle, which comprises the steps of: (a) checking whether road information including position data and traffic snarl data is received from a fixed transmitter; (b) if received, storing the received road information; (c) displaying a road map on the display unit on the basis of the received position data; (d) displaying traffic snarl information on the displayed road map on the basis of the received traffic snarl data; (e) if road information is not received beyond a predetermined time period, calculating vehicle positions by a vehicle position detecting unit to display a new road map on the display unit; (f) checking whether a predetermined time-related condition is satisfied after the last road information has been received; (9) if not satisfied, keeping the last traffic snarl information displayed on the road map; and (h) if satisfied, deleting the last traffic snarl information from the road map.

The predetermined time-related conditions are predetermined time period, an average time period determined according to road, time and weather conditions, predetermined times at which morning and evening rash hours end, a predetermined time period determined according to seasonal road conditions, a predetermined time period determined according to the degree of a traffic accident, etc.

Further, in the second aspect of the present invention, the traffic snarl information displayed on the road map is deleted when a predetermined distance-related condition is satisfied after the road information has been received.

The predetermined distance-related conditions are predetermined vehicle travel distance, an average vehicle travel distance determined according to road, time and weather conditions, an average vehicle travel distance determined according to seasonal road conditions, a vehicle travel distance determined according to the degree of a traffic accident, a vehicle travel distance determined according to road construction, etc.

Further, it is preferable to change color in which the traffic snarl information is displayed, according to the lapse of time in the order to red, orange and yellow, for instance, before the last traffic snarl information is deleted from the road map.

In the road map displaying system for an automotive vehicle according to the present invention, since traffic snarl information can be deleted or changed in color display according to the lapse of time or travel distance after the previous road information has been received, when the vehicle is travelling on a road along which no radio beacon transmitters are arranged, it is possible to provide more reliable road information without allowing the driver from being confused with the old road information.

DETAILED DESCRIPTION OF THE PREFERRED EMBODIMENTS

Embodiments of the road map displaying system according to the present invention will be described hereinbelow with reference to the attached drawings.

Figure 1:
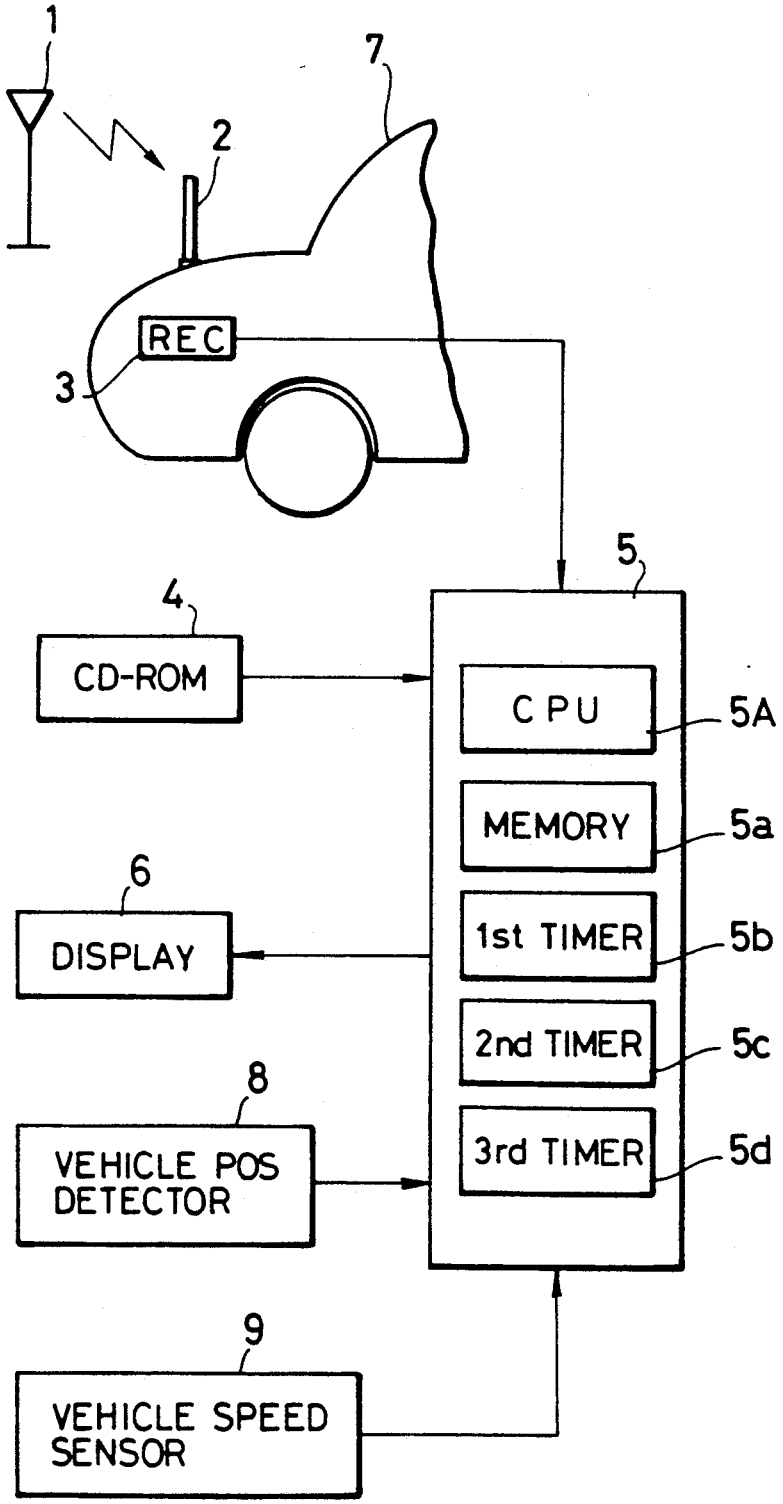
FIG. 1 is a schematic block diagram showing the basic system configuration of the road map displaying system for an automotive vehicle according to the present invention.

FIG. 1 is a block diagram showing the system configuration thereof. A traffic radio beacon (fixed) transmitter I is arranged along a road and transmits road information to vehicles travelling therearound. The system mounted on a vehicle 7 comprises a beacon receiver 3 for receiving road information transmitted by the fixed beacon transmitter I via an antenna 2; a CD-ROM (compact disc read only memory) 4 for storing various map information classified according to districts; a processing unit 5 including a central processing unit 5A, a buffer memory 5*a*, and three timers 5*b*, 5*c*, and 5*d*; a display unit 6 (e.g. cathode ray tube, liquid crystal display, etc. ) ; a vehicle position detecting unit 8 composed of an earth magnetism sensor and a travel distance meter, for instance, and a vehicle speed sensor 9. The processing unit 5 reads a road map related to an area where the vehicle is now travelling from the CD-ROM 4 on the basis of road information transmitted from the beacon transmitter 1, and displays the read road map on the display unit 6. In addition, the processing unit 5 displays traffic snarl information on the road map displayed by the display unit 6. The vehicle position detecting unit 8 detects the current vehicle position when the vehicle is travelling on a road along which no traffic beacon transmitters I are arranged. Without being limited to the above-mentioned detecting unit 8, it is also possible to detect the current vehicle travelling position by means of a global positioning system based upon a communications satellite.

Figure 2:
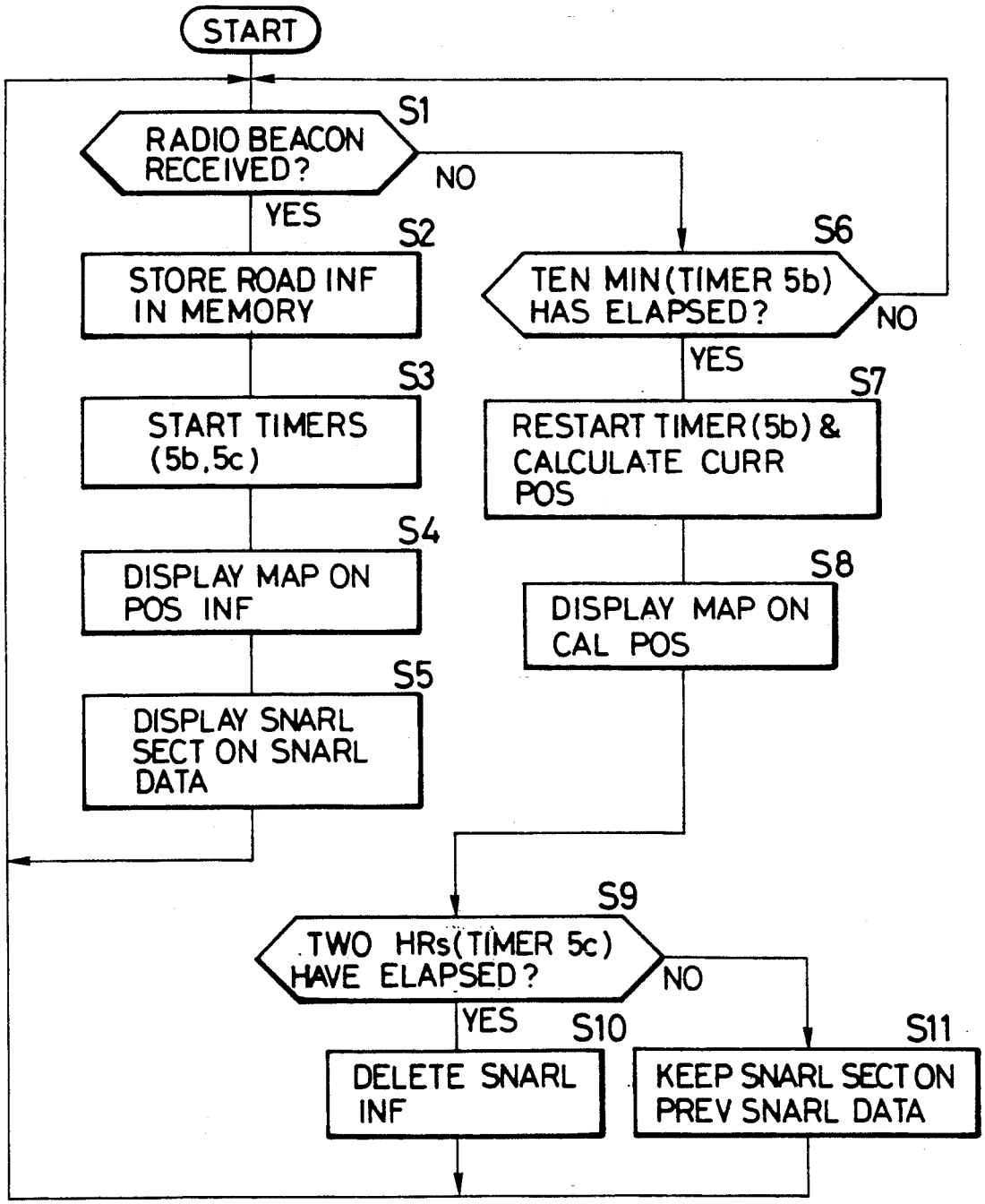
FIG. 2 is a flowchart showing the display control process, for assistance in explaining a first aspect of the present invention, in which the traffic snarl information is deleted on the basis of the time-related condition.

The operation of the first aspect of the system according to the present invention will be described hereinbelow with reference to FIG. 2 which shows a control program executed by the processing unit 5.

Control first checks whether a radio beacon signal is received by the beacon receiver 3 via the beacon antenna 2 (in step SI). If received, control proceeds to step 2. If not received, control proceeds to step S6. Control stores the received road information including position data and traffic snarl data in the memory 5*a*, and resets the first and second timers 5*b* and 5*c* for timer activation (in step S3). The first timer 5*b* serves to update the current vehicle position on the displayed map. That is, when no radio beacon signal is received beyond a first predetermined time period (e.g. 10 minutes), control determines that the vehicle is travelling on the road along which no beacon transmitters are arranged, and calculates the current vehicle position by means of the vehicle position detecting unit 8, instead of the current position data transmitted by the beacon transmitter 1, to update the road map. The second timer 5*c* serves to delete the current traffic snarl information on the displayed map. That is, when the succeeding road information is not received beyond a second predetermined time period (e.g. 2 hours) control deletes the previously received traffic snarl information.

Control reads the current position data of the road information transmitted by the beacon transmitter 1 stores the read data in the buffer memory, 5*a*, and displays the current road map selected from various road maps stored in the CD-ROM 4 on the basis of the read position data on the display unit 6 (in step S4).

In addition, control reads traffic snarl data of the road information transmitted by the beacon transmitter 1, stores the read data in the buffer memory 5*a*, and displays the traffic snarl sections on the display unit 6 in a color different from that for displaying roads (in step S5). Thereafter, control returns to the step S1 to update the displayed road map and traffic snarl sections on the basis of the newest road information whenever the succeeding radio beacon signal is received.

When control proceeds to step S6 because no radio beacon signal is received, control checks whether the first predetermined time period (e.g. 10 minutes) has elapsed by means of the first timer 5*b* after the last radio beacon signal was received (in step S6). If YES, control proceeds to step S7. If NO, control returns to step S1. Control resets the first timer 5*b* for reactivation, and calculates the current vehicle position by means of the vehicle position detecting unit 8 (in step S7). Further, control displays the current road map corresponding to the calculated current vehicle position from those stored in the CD-ROM on the display unit 6 (in step S8). Here, it is also preferable to allow the vehicle position detecting unit 8 to always calculate the current vehicle position.

Control checks whether the second predetermined time period (e.g. 2 hours) has elapsed by means of the second timer 5*c* after the last radio beacon signal was received (in step S9). If YES, control deletes the traffic snarl sections displayed on the basis of the last road information (in step S10). If NO, control keeps the traffic snarl sections displayed on the basis of the last road information (in step S11). Thereafter, control returns to step S1.

As described above, in the first aspect of the present invention since the traffic snarl sections are deleted when road information is not received by a radio beacon receiver beyond a predetermined time period (e.g. 2 hours), it is possible to prevent the driver from being confused with the previous traffic snarl information.

Figure 3A:
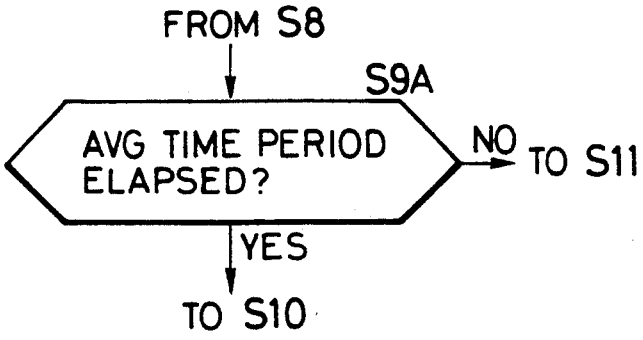
FIGS. 3*a*, 3*b*, 3*c*, and 3*d* show a step of the display control process, for assistance in explaining some modifications of the first aspect of the present invention.
Figure 3B:
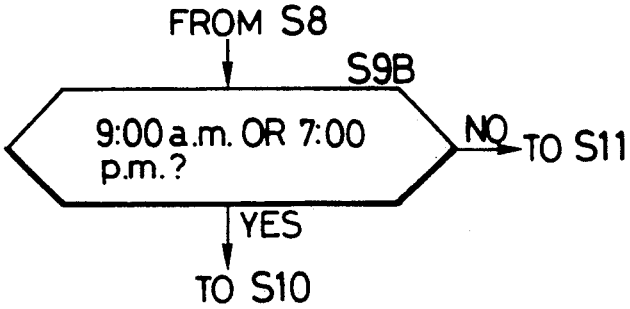
Figure 3C:
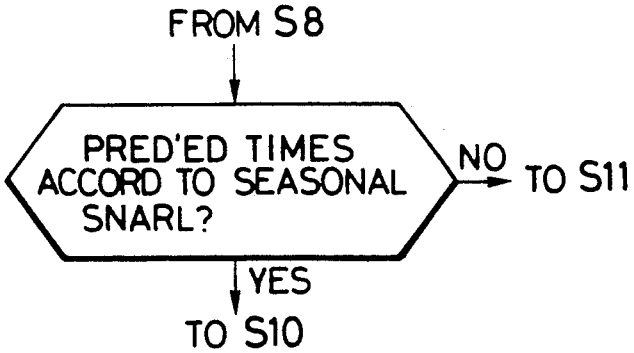
Figure 3D:
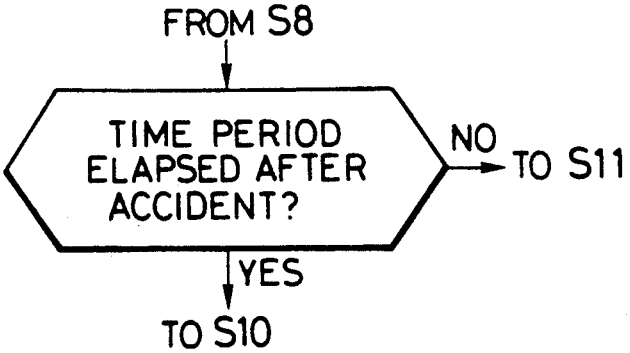

In the above embodiment, the traffic snarl information is deleted on the basis of a fixed predetermined time period (e.g. 2 hours) elapsed after the last road information. Without being limited thereto, it is possible to delete the displayed traffic snarl information on the basis of other time-related conditions. In more detail, the traffic snarl information can be deleted on the basis of an average time period determined according to roads, time and weather conditions as shown in FIG. 3*a*, a predetermined time (e.g. 9:00 a.m.) in the morning at which morning rush hours end or a predetermined time (e.g. 7:00 p.m.) in the evening at which evening rush hours end, as shown in FIG. 3*b*, a predetermined time period determined according to seasonal road conditions as shown in FIG. 3*c*, a time period determined according to the degree of a traffic accident, as shown in FIG. 3*d*, etc. In every case, since the above-mentioned times or time periods at or during which traffic snarl may occur are previously known according to the roads, time, weather and seasonal conditions by the traffic control center, it is preferable to transmit these time-related conditions from the fixed beacon transmitters in addition to the conventional road information (position and traffic snarl data). In any cases, the traffic snarl information displayed on the road map is to be deleted whenever the above-mentioned time-related conditions transmitted by the fixed beacon transmitter are satisfied.

Further, it is also possible to delete the old traffic snarl information on the basis of distance-related conditions, instead of the above-mentioned time-related conditions.

Figure 4:
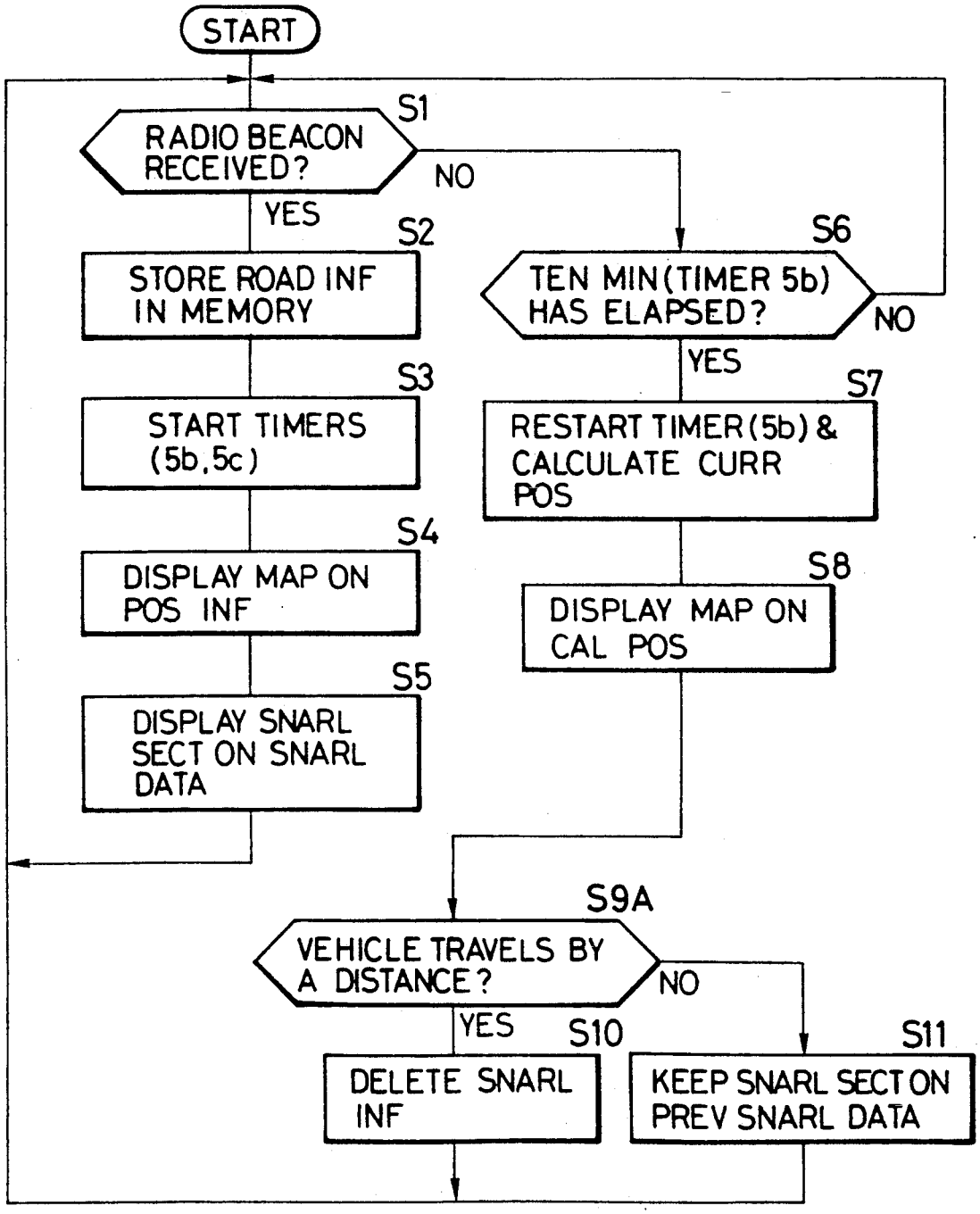
FIG. 4 is a flowchart showing the display control process, for assistance in explaining a second aspect of the present invention, in which the traffic snarl information is deleted on the basis of distance-related condition.

FIG. 4 is a flowchart for assistance in explaining the second aspect of the present invention, in which the old traffic snarl information is deleted on the basis of the distance-related conditions. The process shown in FIG. 4 is the same as that shown in FIG. 2 except the step S9A. In step S9A, control checks whether the vehicle has travelled by a predetermined distance, after the last traffic snarl information was received by the last radio beacon transmitter 1. The vehicle distance travelled can be calculated on the basis of data obtained by the vehicle speed sensing unit 9 and another timer. The similar step numerals have been retained for the same steps which have the same functions, without repeating any detailed description thereof.

Similarly to the time-related conditions and without being limited to a predetermined fixed travel distance, it is possible to delete the displayed traffic snarl information on the basis of other distance-related conditions such as an average vehicle travel distance determined according to roads, time and weather conditions, an average vehicle travel distance determined according to seasonal road conditions, a vehicle travel distance determined according to a traffic accident, a vehicle travel distance determined according to road construction, etc. These distance-related conditions are preferably transmitted from the beacon transmitters in addition to the conventional road information.

Figure 5A:
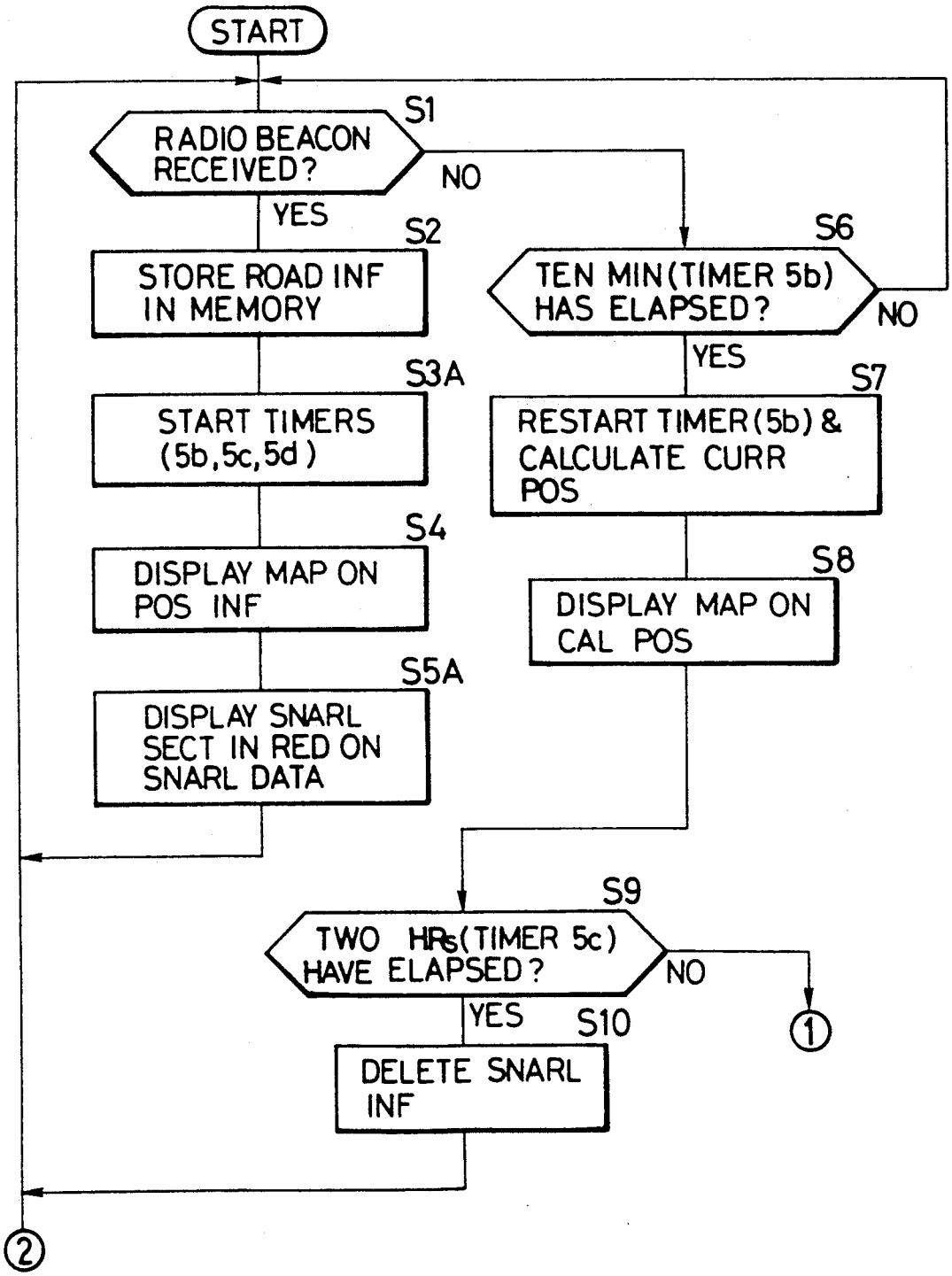
FIGS. 5A and 5B show a flowchart showing a display control process, for assistance in explaining another embodiment of the present invention.
Figure 5B:
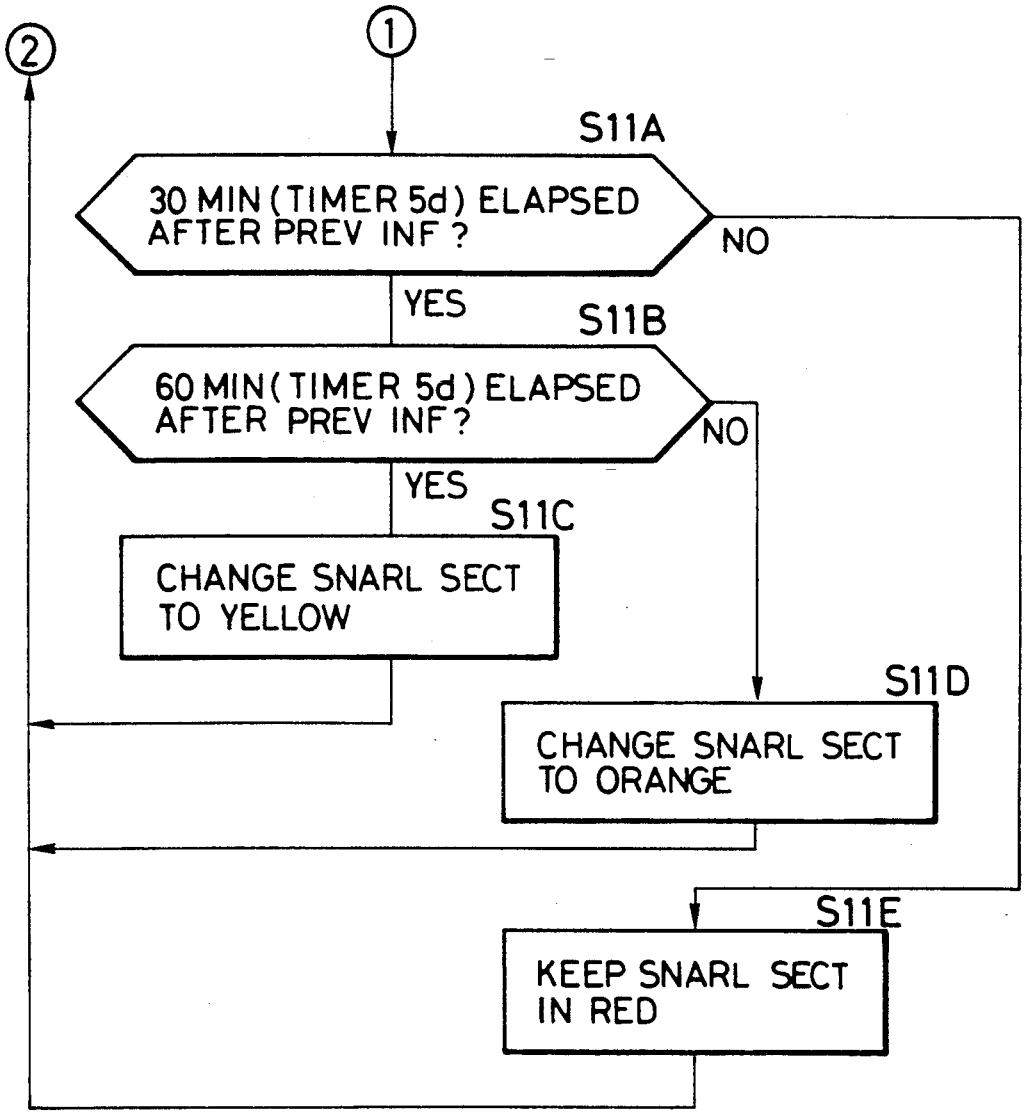

Another embodiment of the present invention will be described hereinbelow with reference to FIGS. 5A and 5B. In this embodiment, he traffic snarl sections are varied in display color with the lapse of time after road information has been received. In this embodiment, only a third timer 5*d* is additionally required for the system shown in FIG. 1. Further, only processes S3A, S5A and S11A to S11E shown in FIGS. 5A and 5B are different from those shown in FIG. 2. The similar step numerals have been retained for the same steps which have the same functions, without repeating the description thereof.

Control resets and restarts all the timers 5*b*, 5*c* and 5*d* (in step S3A) and displays the current traffic snarl sections in red, for instance (in step S5A).

With reference to FIG. 5B, control checks whether a predetermined time period (e.g. 30 minutes) has elapsed after the preceding traffic snarl information was received by means of the third timer 5*d* (in step S11A) If YES, control further checks whether another predetermined time period (e.g. 60 minutes) has elapsed after the preceding traffic snarl information was received by means of the same third timer 5*d* (in step S11B). If YES in step S11B, control changes the display color of the snarl sections to yellow (in step S11C). Further, if NO in step 11B, control changes the display color thereof to orange (in step S11D). If NO in step 11A, control keeps the traffic snarl sections displayed in red. In other words, the traffic snarl sections are displayed in red for 30 minutes, in orange between 30 and 60 minutes, in yellow between 1 and 2 hours, and deleted 2 hours after the preceding traffic snarl information was received by the radio beacon receiver 3.

In this embodiment, since the traffic snarl information is varied in color with the lapse of time after the road information has been received, it is possible to discriminate the reliability of traffic snarl information on the basis of display colors.

When the vehicle is travelling on a highway, since many radio beacon transmitters are usually arranged along the highway, road information including road map data and traffic snarl data must be updated frequently in a short time, so that the processing unit 5 becomes busy. To reduce load applied to the processing unit 5 when the vehicle is travelling on a highway, it is preferable to delete traffic snarl information related to ordinary roads other than the highway. Further, when the vehicle comes down to the ordinary road, it is preferable to display again the traffic snarl information related to the ordinary roads. In this case. it is possible to determine whether the vehicle is travelling on a highway by checking whether the vehicle speed higher than 80 km/h is kept more than 10 minutes, for instance.

Further, it is possible to determine whether the current traffic snarl information is related to a highway or an ordinary road, on the basis of road map data or traffic snarl data transmitted by the beacon transmitter.

As described above, in the road map displaying system according to the present invention, since traffic snarl information can be deleted or changed in color display according to the lapse of time or travel distance after the previous road information has been received, when the vehicle is travelling on a road along which no radio beacon transmitters are arranged, it is possible to provide more reliable road information without allowing the driver from being confused with the old road information.

What is claimed is:

1. A road map displaying system for an automotive vehicle for displaying road information transmitted by fixed transmitters on a display unit of an automotive vehicle, which comprises:

(a) means for receiving road information including position data and traffic snarl data transmitted by the fixed transmitters;

(b) means for storing a plurality of road maps;

(c) means for selecting a current road map from those stored in said storing means on the basis of the received position data;

(d) means for displaying traffic snarl information on the selected road map on the basis of the received traffic snarl data;

(e) means for measuring time elapsed after the road information from the fixed transmitter has been received by said receiving means; and (f) means for deleting the traffic snarl information displayd on the selected road map, when a predetermined time-related condition is satisfied after the road information has been received.

wherein the predetermined time-related condition is an average time period predetermined according to roads, time of day and weather conditions.

2. The road map displaying system for an automotive vehicle of claim 1, wherein the predetermined time-related condition is a predetermined time in the morning at which morning rush hours end.

3. The road map displaying system for an automotive vehicle of claim 1, wherein the predetermined time-related condition is a predetermined time in the evening at which evening rush hours end.

4. The road map displaying system for an automotive vehicle of claim 1, wherein the predetermined time-related condition is a predetermined time period determined according to seasonal road conditions.

5. The road map displaying system for an automotive vehicle of claim 1, wherein the predetermined time-related condition is a time period determined according to the degree of a traffic accident.

6. The road map displaying system for an automotive vehicle of claim 1, which further comprises means for varying color in which traffic snarl information is displayed, according to the lapse of time, before the traffic snarl information is deleted from the road map on the basis of the predetermined time-related condition.

7. The road map displaying system for an automotive vehicle of claim 1, which further comprises means for deleting traffic snarl information for roads other than a highway on which the vehicle is currently travelling at a speed higher than a predetermined speed for a time duration longer than a predetermined time duration.

8. The road map displaying system for an automotive vehicle of claim 1 further comprising means for calculating position of the vehicle displayed on the current road map if the road information is not received during a present time period.

9. The road map displaying system for an automotive vehicle of claim 8, wherein means for deleting comprises means for erasing the traffic snarl information from the current road map displaying the calculated position of the vehicle, when the predetermined time-related condition is satisfied.

10. A road map displaying system for an automotive vehicle for displaying road information transmitted by fixed transmitters on a display unit of an automotive vehicle, which comprises:

(a) means for receiving road information including position data and traffic snarl data transmitted by the fixed transmitters;

(b) means for storing a plurality of road maps;

(c) means for selecting a current road map from those stored in said storing means on the basis of the received position data;

(d) means for displaying traffic snarl information on the selected road map on the basis of the received traffic snarl data;

(e) means for measuring time elapsed after the road information from the fixed transmitter has been received by said receiving means; and (f) means for deleting the traffic snarl information displayed on the selected road map, when a predetermined distance-related condition is satisfied after the road information has been received;

wherein the predetermined distance-related condition is a predetermined vehicle travel distance.

11. The road map displaying system for an automotive vehicle of claim 10, wherein the predetermined distance-related condition is an average vehicle travel distance determined according to roads, time of day and weather conditions.

12. The road map displaying system for an automotive vehicle of claim 10, wherein the predetermined distance-related condition is an average vehicle travel distance determined according to seasonal road conditions.

13. The road map displaying system for an automotive vehicle of claim 10, wherein the predetermined distance-related condition is a vehicle travel distance determined according to the degree of a traffic accident.

14. The road map displaying system for an automotive vehicle of claim 10, wherein the predetermined distance-related condition is a vehicle travel distance determined according to road construction.

15. The road map displaying system for an automotive vehicle of claim 10 further comprising means for calculating position of the vehicle displayed on the current road map if the road information is not received during a preset time period.

16. The road map displaying system for an automotive vehicle of claim 15, wherein said means for deleting comprises means for erasing the traffic snarl information from the current road map displaying the calculated position of the vehicle, when the predetermined distance-related condition is satisfied.

17. A method of displaying road information transmitted by fixed transmitters on a display unit for an automotive vehicle, which comprises the steps of:

(a) checking whether road information including position data and traffic snarl data is received from a fixed transmitter;

(b) if received, storing the received road information;

(c) displaying a road map on the display unit on the basis of the received position data;

(d) displaying traffic snarl information on the displayed road map on the basis of the received traffic snarl data;

(e) if road information is not received a predetermined time period, calculating vehicle positions by a vehicle position detecting unit to display a new road map on the display unit;

(f) checking whether a predetermined time-related condition is satisfied after the last road information has been received;

(g) if not satisfied, keeping the last traffic snarl information displayed on the road map; and (h) if satisfied, deleting the last traffic snarl information from the road map.

18. The method of displaying road information of claim 17, which further comprises the steps of changing color in which the traffic snarl information is displayed, according to lapse of time, before the last traffic snarl information is deleted from the road map.

19. A method of displaying road information transmitted by fixed transmitters on a display unit for an automotive vehicle, which comprises the steps of:

(a) checking whether road information including position data and traffic snarl data is received from a fixed transmitter;

(b) if received, storing the received road information;

(c) displaying a road map on the display unit on the basis of the received position data;

(d) displaying traffic snarl information on the displayed road map on the basis of the received traffic snarl data;

(e) if road information is not received during a predetermined time period, calculating vehicle positions by a vehicle position detecting unit to display a new road map on the display unit;

(f) checking whether a predetermined distance-related condition is satisfied after the last road information has been received;

(g) if not satisfied, keeping the last traffic snarl information displayed on the road map; and (h) if satisfied, deleting the last traffic snarl information from the road map.

* * * * *